US008707596B2

(12) United States Patent
Smith et al.

(10) Patent No.: US 8,707,596 B2
(45) Date of Patent: Apr. 29, 2014

(54) METHOD AND APPARATUS FOR MOUNTING SIGNS AND OTHER DISPLAYS

(71) Applicants: Steven E. Smith, Covington, LA (US); Marcel G. Peterson, Madisonville, LA (US)

(72) Inventors: Steven E. Smith, Covington, LA (US); Marcel G. Peterson, Madisonville, LA (US)

( * ) Notice: Subject to any disclaimer, the term of this patent is extended or adjusted under 35 U.S.C. 154(b) by 0 days.

(21) Appl. No.: 13/624,303

(22) Filed: Sep. 21, 2012

(65) Prior Publication Data

US 2013/0019509 A1 Jan. 24, 2013

Related U.S. Application Data

(63) Continuation of application No. 12/658,067, filed on Feb. 2, 2010, now abandoned.

(60) Provisional application No. 61/206,599, filed on Feb. 2, 2009.

(51) Int. Cl.
*G09F 15/00* (2006.01)

(52) U.S. Cl.
USPC ..... 40/607.01; 40/607.11; 40/612

(58) Field of Classification Search
USPC ..... 40/607.01, 607.12, 607.11, 611.06, 612
See application file for complete search history.

(56) References Cited

U.S. PATENT DOCUMENTS

| | | | | | |
|---|---|---|---|---|---|
| 1,826,581 | A | * | 10/1931 | Sprung | 40/607.12 |
| 1,845,967 | A | * | 2/1932 | Fox | 40/607.01 |
| 1,851,046 | A | * | 3/1932 | Horni | 40/607.12 |
| 1,859,578 | A | * | 5/1932 | Baily | 40/611.06 |
| 1,968,219 | A | * | 7/1934 | Pfaff, Jr. | 40/607.01 |
| 1,995,869 | A | * | 3/1935 | Sprung | 40/607.12 |
| 2,114,943 | A | * | 4/1938 | Taylor | 40/612 |
| 2,188,437 | A | * | 1/1940 | Joyce | 40/607.11 |
| 2,849,816 | A | * | 9/1958 | Locke | 40/612 |
| 3,935,655 | A | * | 2/1976 | Fritzinger | 40/607.11 |
| 4,019,271 | A | * | 4/1977 | Latimer | 40/603 |
| 4,262,438 | A | * | 4/1981 | Scherer | 40/611.12 |
| 4,342,168 | A | * | 8/1982 | Schmanski | 40/612 |
| 4,455,775 | A | * | 6/1984 | Fritzinger | 40/607.11 |
| 4,854,063 | A | * | 8/1989 | Brunell | 40/607.11 |
| 5,375,355 | A | * | 12/1994 | Rhoads | 40/607.11 |

* cited by examiner

*Primary Examiner* — Shin Kim
(74) *Attorney, Agent, or Firm* — Ted M. Anthony

(57) ABSTRACT

A street sign mounting assembly has a universal sign post cap and at least one sign holder bracket. The cap is universally adapted to fit common street sign posts including, without limitation, square, round and U-channel posts. The sign holder brackets are designed to hold street signs of varying thicknesses.

6 Claims, 6 Drawing Sheets

METHOD AND APPARATUS FOR MOUNTING SIGNS AND OTHER DISPLAYS

CROSS REFERENCES TO RELATED APPLICATION

This application is a continuation-in-part of U.S. Non-Provisional patent application Ser. No. 12/658,067, filed Feb. 2, 2010, currently pending, which claims priority of U.S. Provisional Patent Application Ser. No. 61/206,699 filed Feb. 2, 2009, which are incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention relates to a method and apparatus for mounting and displaying street signs and/or other displays on sign posts or poles.

2. Brief Description of the Prior Art

Street identification and traffic signs are well known and in common use with a variety of designs and mounting hardware. In most cases, signs commonly comprise elongated planar surfaces, but can be manufactured having different shapes and thicknesses. For example, some signs may have an overall uniform thickness, while others may be manufactured with thickened edges at their margins. Moreover, street signs are installed and maintained typically by individual municipalities on different types of posts using varying types of mounting assemblies.

Inconsistent mounting configurations frequently make it necessary for maintenance crews to carry a large inventory of street sign mounting hardware. As such, a universally adaptable street sign mounting assembly would greatly reduce the hardware inventory that maintenance crews are required to carry, and that municipalities are required to maintain. Thus, it is desirable to provide a street sign assembly that is not only adaptable to fit a variety of street signs having varying dimensions, but also is one that is adaptable to fit most commonly-used existing street sign posts.

Street signs are also subject to various types of abuse and/or damage, such as from changing weather conditions, theft, and intentional vandalism. Because street signs are used almost exclusively outdoors, varying weather conditions make it essential that the mounting hardware be constructed of strong and durable materials capable of resisting natural forces.

The prior art has provided street sign holder assemblies that attempt to solve the above problems. Street sign holder assemblies most commonly used today are typically made of die cast aluminum and fastened to a sign post with zinc plated carbon steel screws. This combination of metals frequently causes electrolysis (often appearing as rust) and makes replacement of signs difficult. Moreover, traditional die cast aluminum street sign mounting assemblies generally require a different post cap for different types of sign posts which tend to have loose tolerances and must be adjusted and held in place with screws. The use of loose fitting mounting hardware and conventional fasteners makes such existing street signs vulnerable to theft and vandalism. Accordingly, street sign hardware should be manufactured using strong, weather resistant materials and should be beneficially designed to prevent theft and vandalism.

SUMMARY OF THE PRESENT INVENTION

In its preferred embodiment, the present invention seeks to solve these problems by providing a street sign holder and cap assembly generally comprising a universal cap member having a sign holder bracket.

The cap member of the present invention is universally adapted to fit most common types of street sign posts including, but not necessarily limited to, round posts, square posts, and U-channel posts. In the preferred embodiment, said cap member of the present invention requires no bolts, screws, or fasteners for connection to a sign post. Instead of using such fasteners, the cap of the present invention can be frictionally secured to the top of such sign post using a press/interruption fit.

The sign holder bracket of the present invention can beneficially fit both flat and extruded signs of varying thicknesses, and can also accommodate the mounting of multiple signs oriented back to back. Further, minimal, if any, tools are required to mount a sign or other display using the mounting assembly of the present invention.

It is an object of the present invention to provide a sign post cap that is universally adapted to easily fit the most common types of street sign posts in use today.

It is a particular object of the present invention to provide a street sign assembly adaptable to fit street signs of varying thickness.

It is a further object of the present invention to provide a sign holder bracket capable of accepting both extruded signs and flat signs.

It is another object of the present invention to provide a sign holder assembly having a fastening mechanism that is less susceptible to vandalism and theft.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

Figure 1:
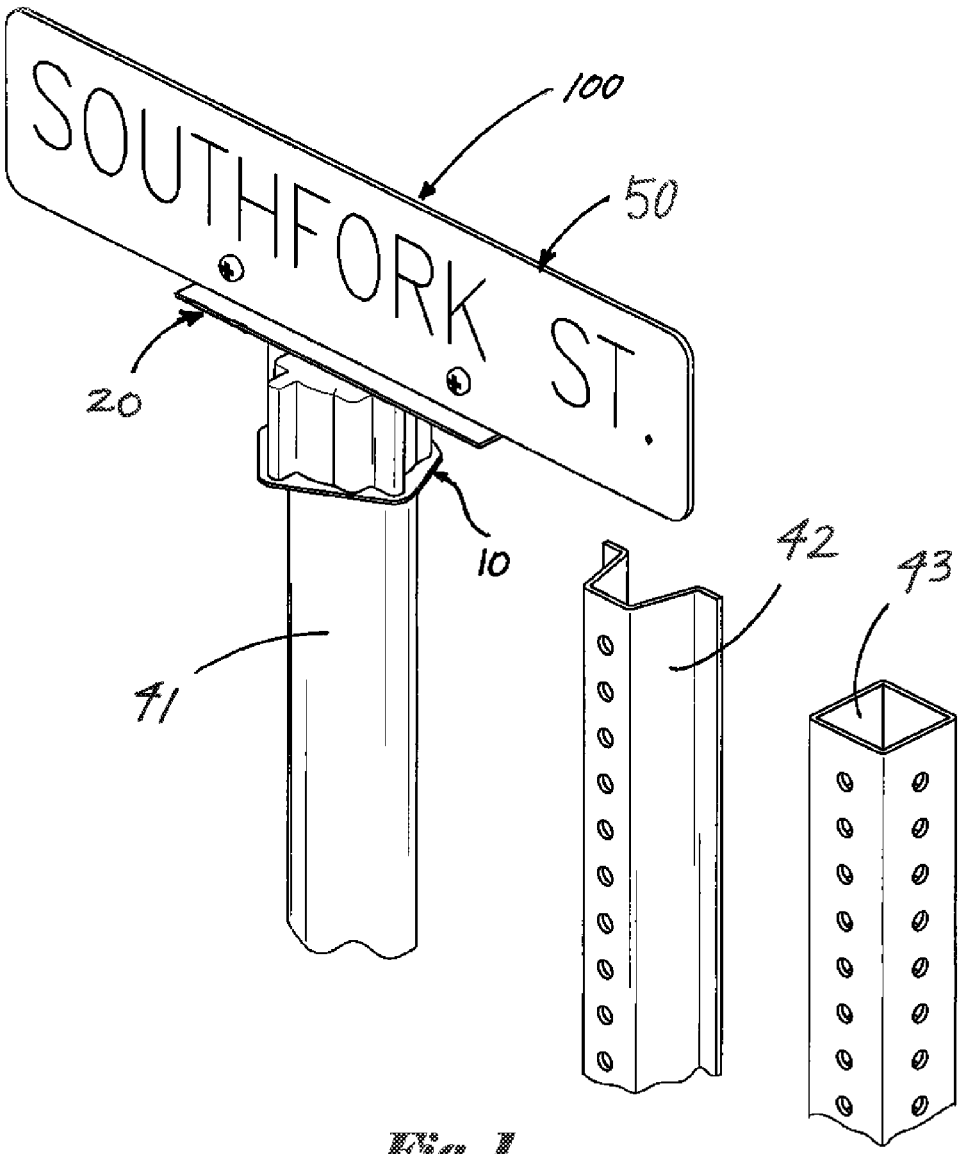
FIG. 1 depicts a perspective view of the sign mounting assembly of the present invention, and prior art posts used in connection with the present invention.

Referring now to the drawings, FIG. 1 depicts a perspective view of mounting assembly 100 according to a preferred embodiment of the present invention. In the configuration depicted in FIG. 1, mounting assembly 100 generally comprises a combination of cap 10 and at least one sign holder bracket 20. The configuration depicted in FIG. 1 generally pertains to a common street sign application using a substantially planar, rectangular street sign. However, it is to be observed that mounting assembly 100 of the present invention permits mounting of signs or other displays in many different configurations other than the configuration depicted in FIG. 1 including, without limitation, at an intersection of a plurality of streets wherein at least two street signs are mounted in perpendicular orientation relative to one another.

Still referring to FIG. 1, mounting assembly 100 is installed near the upper end of substantially cylindrical sign post 41. However, as more fully described below, mounting assembly 100 of the present invention can also be beneficially mounted on posts having other shapes and sizes, such as U-channel post 42 and substantially rectangular (square) post 43. Still referring to FIG. 1, cap 10 is received on the upper end of sign post 41. Sign holder bracket 20 is attached to said cap 10, as well as the lower portion of first street sign 50, and holds said first street sign 50 securely in place in a manner more fully described herein.

Figure 2:
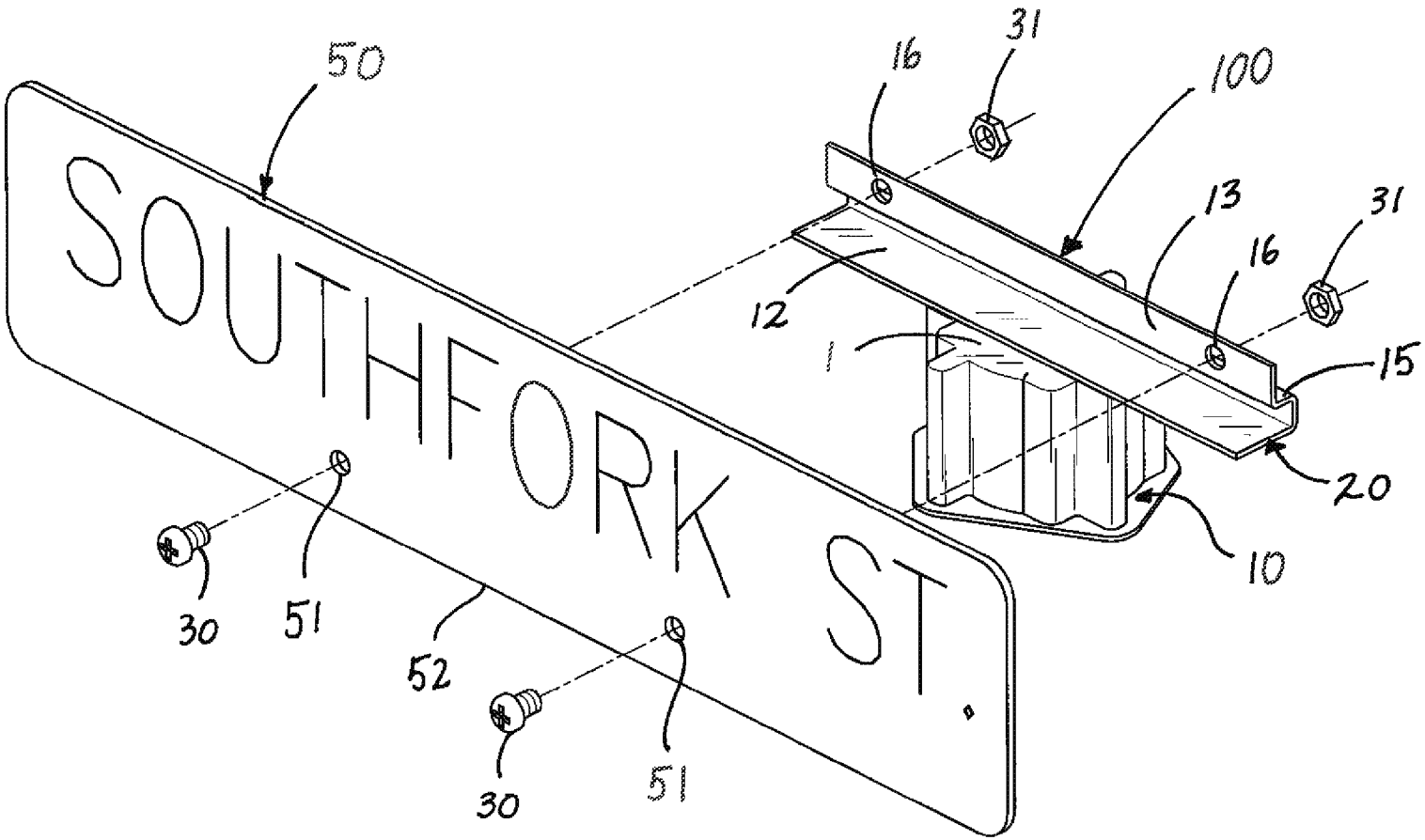
FIG. 2 depicts an exploded perspective view of the sign mounting assembly of the present invention.

FIG. 2 depicts an exploded perspective view of sign mounting assembly 100 of the present invention. Cap 10 can be received on the upper end of a sign post 42 (not shown in FIG. 2). Sign holder bracket 20 is attached to said cap 10, as well as the lower portion of street sign 50, and can be used to hold street sign 50 securely in place. Said sign holder bracket 20 is welded or otherwise permanently attached to upper surface of top 1 of cap 10.

In the preferred embodiment, said sign holder bracket 20 generally comprises a substantially planar lower base member 12 having a substantially flat upper surface, as well as a substantially planar side member 13, itself having a substantially flat inner surface. Said lower base member 12 and side member 13 are oriented substantially perpendicular to one another, thereby forming a right angle between said members. In most applications, said lower base member 12 is disposed in a substantially horizontal orientation, while said side member 13 is oriented in a substantially vertical orientation. Further, in the preferred embodiment, sign holder bracket 20 can include channel member 15 formed between lower base member 12 and side member 13. By way of illustration, but not limitation, it is to be observed that sign holder bracket 20 can be formed or fabricated (typically by bending) from a single sheet of material exhibiting desired characteristics.

Still referring to FIG. 2, sign holder bracket 20 (and, more specifically, side member 13 thereof) can include transverse bores 16. Similarly, sign 50 can also include bores 51, beneficially positioned to align with bores 16 of sign holder bracket 20. When attachment of sign 50 to sign holder bracket 100 is desired, sign 50 can be placed on sign holder bracket 50 such that lower edge 52 of said sign 50 is disposed on or in proximate relationship to lower base member 12 of sign holder bracket 20. Bores 51 of sign 50 are aligned with bores 16 of side member 13 of sign holder bracket 20. Fasters can then be used to secure said sign 50 to said sign holder bracket 20; although other fastening means can be used, as depicted in FIG. 2, threaded bolts 30 are received within said aligned bores 51 and 16, and mating nuts 32 are tightened onto bolts 30 in a manner well known to those having skill in the art.

Figure 3:
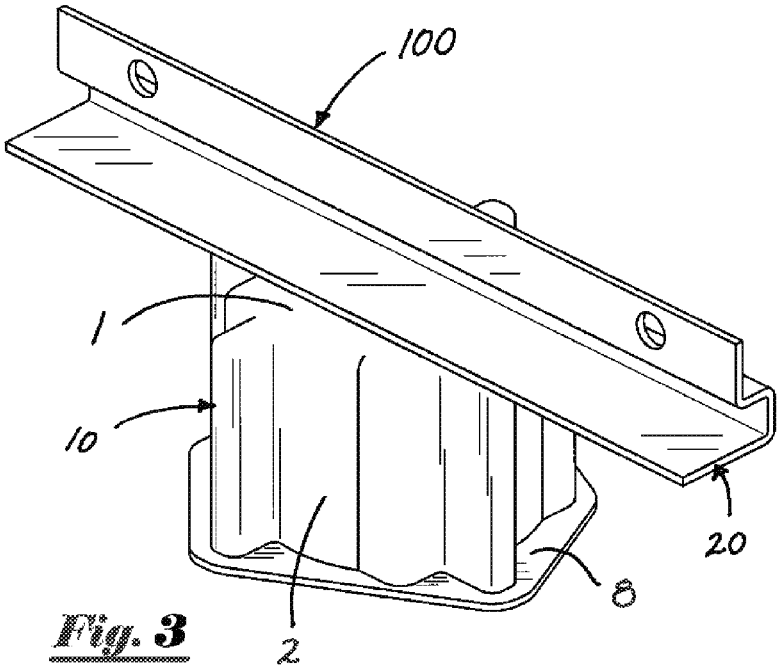
FIG. 3 depicts a perspective view of the sign mounting assembly of the present invention.
Figure 4:
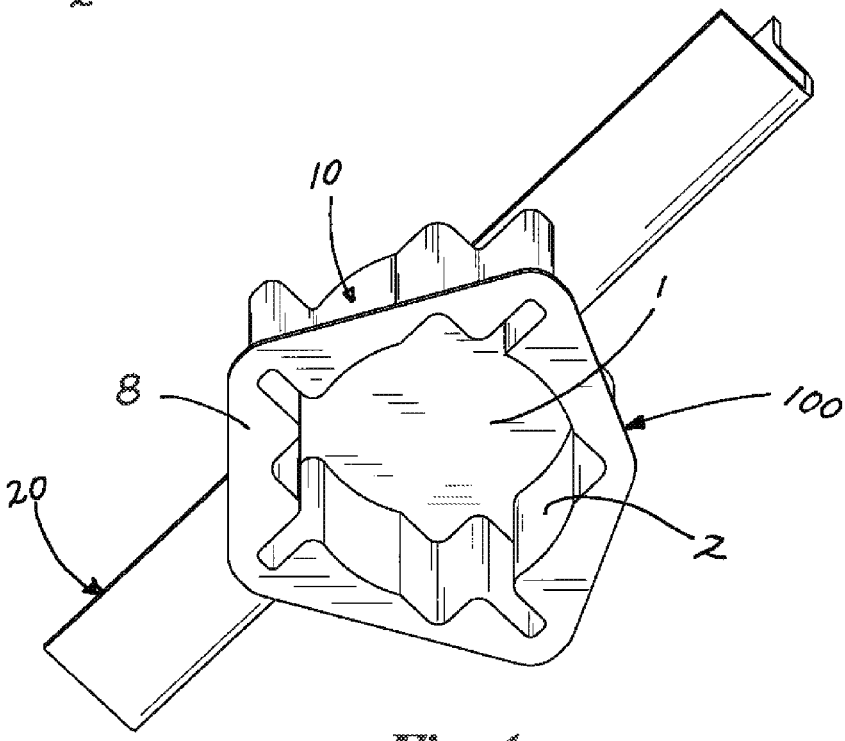
FIG. 4 depicts a bottom perspective view of the sign mounting assembly of the present invention.
Figure 5:
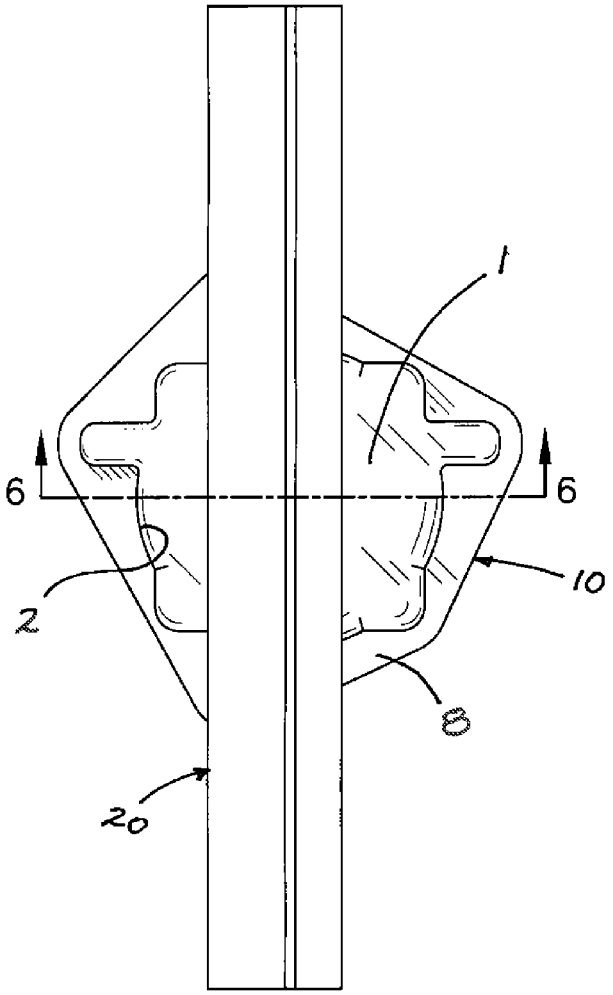
FIG. 5 depicts a top view of a cap member of the sign mounting assembly of the present invention.

FIG. 3 depicts a perspective view of a cap 10 of sign mounting assembly 100 of the present invention, while FIG. 4 depicts a bottom perspective view of cap 10 of sign mounting assembly 100 of the present invention. FIG. 5 depicts a bottom view of cap 10 of the sign mounting assembly 100 of the present invention, while FIG. 6 depicts a side section view of cap 10 along line 6-6 of FIG. 5.

Referring to FIGS. 3 and 4, cap 10 generally comprises a substantially planar top member 1, interconnecting side walls 2 extending from said top 1, and substantially planar lower flange 8 extending around said interconnecting wall member 2. Said top 1 and interconnecting side walls 2 cooperate to form a cavity; said side walls are generally configured to fit around the upper portions of sign posts as more fully described below. In other words, the upper portion of said sign posts can be received within the cavity formed by said cooperating top 1 and interconnecting side walls 2. In the preferred embodiment, planar top 1 is oriented substantially parallel to flange member 8 which extends radially outward around the base of said interconnecting side walls. Cap 10 (including, but not limited to interconnecting side walls 2 thereof) defines a universal profile adapted to permit cap 10 to be received on round posts, square posts, and U-channel posts.

Referring to FIG. 5, cap 10 has substantially planar top 1 (which can define a substantially flat surface), interconnecting side walls 2 extending from said top 1 (not clearly visible in FIG. 5), and lower flange member 8. Said sign holder bracket 20 is permanently attached to the upper surface 1 of cap 10. Although other means of attaching said sign holder bracket to cap 10 can be envisioned, in the preferred embodiment said sign holder bracket 20 is welded to cap 10

Figure 6:
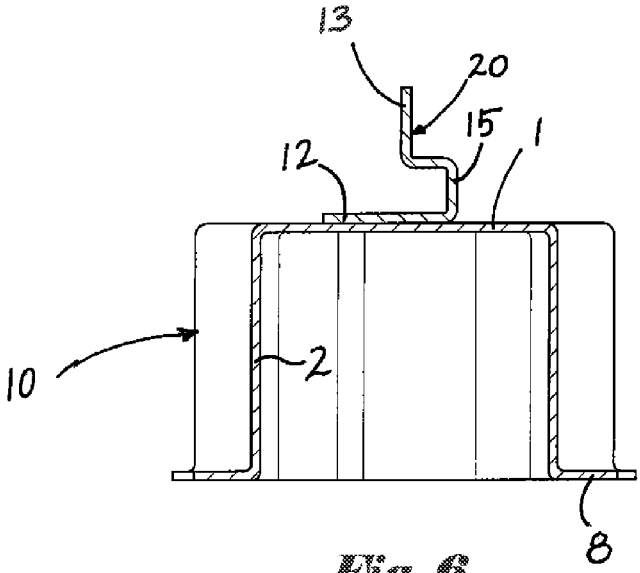
FIG. 6 depicts a side sectional view of a cap member of the sign mounting assembly of the present invention along line 6-6 of FIG. 5.

FIG. 6 depicts a side section view of cap 10 along line 6-6 of FIG. 5. Cap 10 has substantially planar top 1, interconnecting side walls 2 extending from said top 1, and lower flange 8. In the preferred embodiment, said sign holder bracket 20 generally comprises a substantially planar lower base member 12 having a substantially flat upper surface, as well as a substantially planar side member 13, itself having a substantially flat inner surface. Said lower base member 12 and side member 13 are oriented substantially perpendicular to one another, thereby forming a right angle between said members. In most applications, said lower base member 12 is disposed in a substantially horizontal orientation, while said side member 13 is oriented in a substantially vertical orientation.

In the preferred embodiment, sign holder bracket 20 can include offset channel member 15 formed between lower base member 12 and side member 13. By way of illustration, but not limitation, it is to be observed that sign holder bracket 20 can be formed or fabricated (typically by bending) from a single sheet of metal or other material exhibiting desired characteristics.

The irregular design of interconnecting side walls 2 of cap 10 enables cap 10 to be universally received on most common types of street sign posts. In many applications, cap 10 can install on a street sign post with an interruption or press fit, whereby the top of said street sign post is axially received into the interior space defined by said side walls 2, thereby causing a frictional gripping engagement between the interior surfaces of said interconnecting side walls 2 and the exterior surface of said street sign post. If desired, one or more fasteners (not depicted in FIG. 6) such as threaded bolts or the like can be used to further secure said cap member 10 to a post; however, it is to be observed that said fasteners are frequently not required for installation of the present invention.

Figure 7:
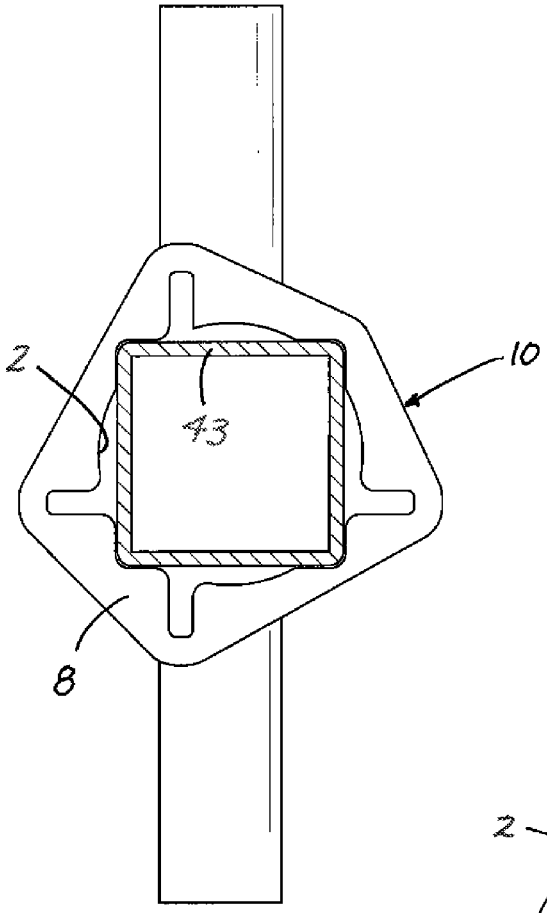
FIG. 7 depicts a bottom view of a cap member of the sign mounting assembly of the present invention received on a square post.
Figure 8:
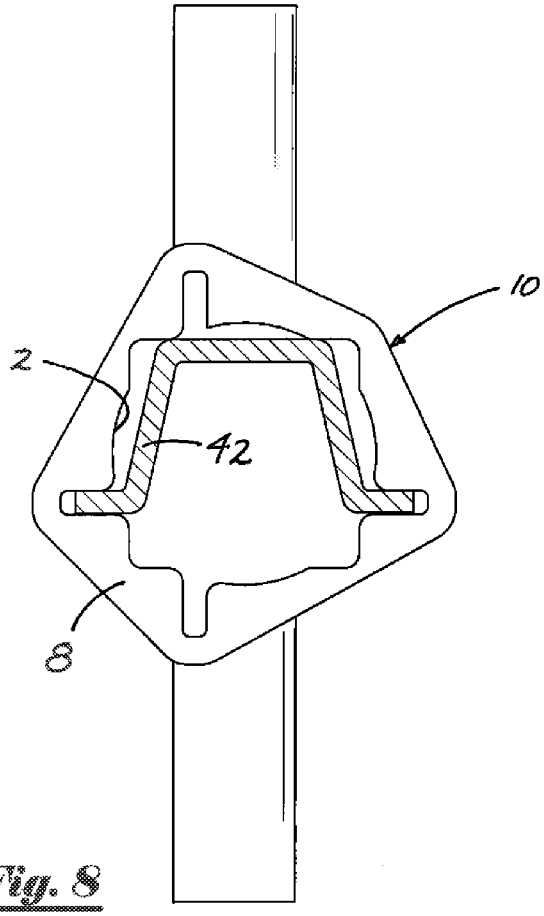
FIG. 8 depicts a bottom view of a cap member of the sign mounting assembly of the present invention received on a U-channel post in a first configuration.
Figure 9:
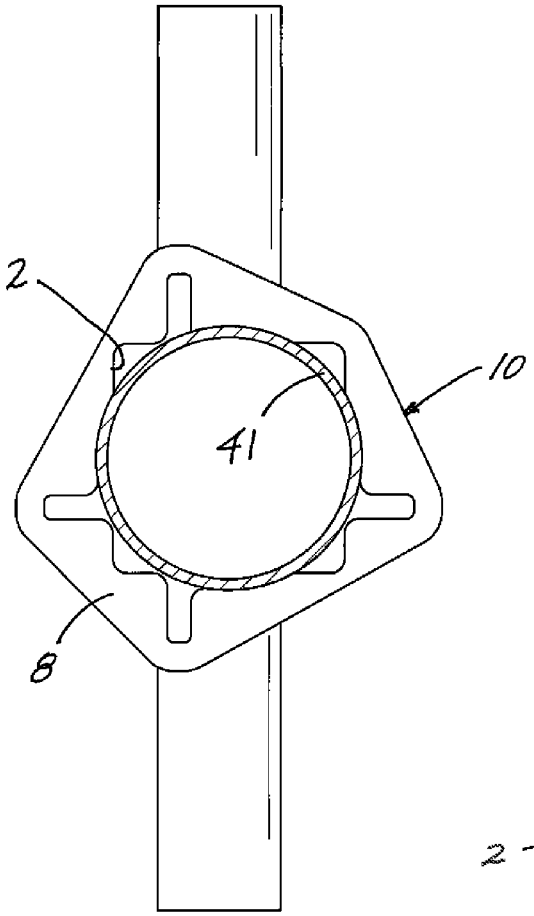
FIG. 9 depicts a bottom view of a cap member of the sign mounting assembly of the present invention received on a round post.
Figure 10:
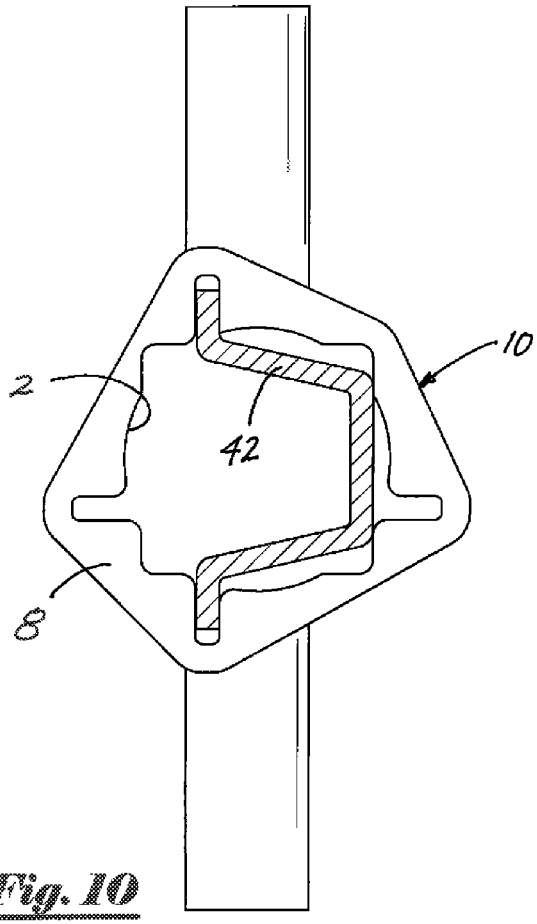
FIG. 10 depicts a bottom view of a cap member of the sign mounting assembly of the present invention received on a U-channel post in a second configuration.

FIG. 7 depicts a bottom view of cap 10, having flange 8, received on a square post 43, gripping the outer surface of said post 43 with portions of the inner surface of side walls 2. FIG. 9 depicts a bottom view of cap 10, having flange 8, received on a circular post 41, gripping the outer surface of said post 41 with portions of the inner surface of side walls 2. FIG. 8 depicts a bottom view of cap 10, having flange 8, received on a U-channel post 42, gripping the outer surface of said post 42 with portions of the inner surface of side walls 2 in a first configuration. FIG. 10 depicts a bottom view of cap 10, having flange 8, received on a u-channel post 42, gripping the outer surface of said post 42 with portions of the inner surface of side walls 2 in a different configuration than depicted in FIG. 9. It is to be observed that in the configurations depicted in FIGS. 8 and 10, cap member 10 is phased approximately 90-degrees relative to u-channel post 42. Accordingly, cap 10 permits orientation of a street sign in multiple directions regardless of the orientation or direction of a u-channel post.

In the preferred embodiment, cap and sign holder brackets of the present invention can be preferably made of stainless steel with progressive dies. Such manufacturing process eliminates pollution commonly associated with the aluminum smelting process used to manufacture traditional street sign mounting hardware. Moreover, cap and sign holder brackets of the present invention are also designed to minimize scrap; there are little or no side or end (blanks/trimmings) scraps and the only scrap pieces generated are the punched out holes and slots. Stainless steel cap and sign holder brackets are lighter in weight and much stronger than die cast aluminum, and do not require any tapped holes or any other secondary production operations. Accordingly, the present invention provides a universally applicable street sign holder assembly that is strong, dependable, long lasting, lightweight, and easy to install.

Sign holder brackets of the present invention are designed to fit both flat and extruded signs of varying thicknesses and can also accommodate two signs, mounted back to back (not shown). The sign holder brackets can be manufactured in varying lengths to accommodate signs of any length. A street sign is preferably fastened to a sign holder bracket using stainless steel or aluminum fasteners, eliminating any corrosion concerns.

Because universal cap member 10 can fit most different sign post configurations commonly in use, the mounting assembly of the present invention eliminates the need for installers and/or maintenance personnel to stock inventory and/or fixtures for many different sign posts to be encountered. Because much of said installation and/or maintenance is performed at remote locations where signs are actually mounted, this greatly reduces the amount and type of inventory or fixtures needed to be carried on trucks or with personnel, where space is typically at a premium. Further, the mounting assembly of the present invention can be installed, removed and maintained without any specialized tools or equipment.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method of mounting a sign comprising:

a. installing a mounting apparatus on the upper end of a post, said mounting apparatus comprising:

i. a cap having a substantially planar top;

ii. a first side wall extending from said top and having at least one outwardly extending curved section and elongate groove;

iii. a second side wall extending from said top, oriented substantially at a right angle to said first side wall, and having at least one outwardly extending curved section and elongate groove;

iii. a third side wall extending from said top, oriented substantially at a right angle to said second side wall and substantially parallel to said first side wall, and having at least one outwardly extending curved section and elongate groove;

iv. a fourth side wall extending from said top, oriented substantially at a right angle to said third side wall and substantially parallel to said second side wall, and having at least one outwardly extending curved section and elongate groove; wherein said top and side walls define a cavity and said cap member is adapted to receive and frictionally grip square, round and U-channel posts in said cavity; and ii. a bracket connected to said top of said cap;

b. attaching a sign to said bracket.

2. The method of claim 1, wherein said bracket further comprises:

a. a substantially planar base having a first end, a second end and a length, wherein said base is attached to the top of said cap; and b. at least one substantially planar side wall extending from said base, wherein said at least one side wall is oriented substantially perpendicular to said base.

3. The method of claim 2, wherein said bracket further comprises at least one transverse bore extending through said side wall.

4. The method of claim 2, wherein said bracket comprises a single piece of metal.

5. A universal cap for attaching items to posts comprising:

a. a substantially planar top; and b. interconnecting side walls, each having an upper end and a lower end, wherein said upper end of said interconnecting side walls are attached to said top, and said top and side walls define a cavity having a substantially rectangular profile with four surfaces, each of which surface has an outwardly extending curved section and an outwardly extending elongate groove, and wherein said cap member is adapted to receive and frictionally grip square, round and U-channel posts in said cavity.

6. The universal cap of claim 5, further comprising a flange member extending radially outward from the lower end of said interconnecting side walls.

* * * * *